US007564192B2

(12) United States Patent
Collins et al.

(10) Patent No.: US 7,564,192 B2
(45) Date of Patent: Jul. 21, 2009

(54) HID DIMMING METHOD AND APPARATUS

(75) Inventors: Byron R. Collins, Tuxedo, NC (US); George E. Kiefer, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/256,870

(22) Filed: Oct. 24, 2005

(65) Prior Publication Data

US 2007/0090769 A1 Apr. 26, 2007

(51) Int. Cl.
*H05B 41/16* (2006.01)

(52) U.S. Cl. ..... 315/247; 315/224; 315/279; 315/209 R; 315/DIG. 4

(58) Field of Classification Search ..... 315/247, 315/246, 312–326, 202–207, 212–219, 272–279, 315/200 R, 209 R, DIG. 4, 352, 224, 225
See application file for complete search history.

(56) References Cited

U.S. PATENT DOCUMENTS

| | | | | |
|---|---|---|---|---|
| 3,218,510 | A | 11/1965 | Schulz | |
| 5,898,273 | A | 4/1999 | Collins et al. | |
| 6,124,684 | A * | 9/2000 | Sievers | 315/307 |
| 6,369,522 | B1 | 4/2002 | Collins | |
| 6,563,255 | B1 | 5/2003 | Collins | |
| 2003/0169027 | A1 * | 9/2003 | Croce et al. | 323/286 |

FOREIGN PATENT DOCUMENTS

| | | |
|---|---|---|
| GB | 726891 | 3/1955 |
| WO | WO-03/047321 A1 | 6/2003 |

OTHER PUBLICATIONS

D. Smith and H. Zhu, Properties of High Intensity Discharge Lamps Operating on Reduced Power Lighting Systems; Paper presented at 1992 Iesna Annual Conference, Journal of the Illuminating Engineering Society, Summer 1993, pp. 27-39.

* cited by examiner

*Primary Examiner*—Tuyet Vo
(74) *Attorney, Agent, or Firm*—Fay Sharpe LLP

(57) ABSTRACT

A HID dimming method and apparatus are provided. The method includes generating a dc waveform during a reduced power dimming mode of operation of the HID lamp, the reduced power dimming mode being less than the full power rating of the lamp, and driving the lamp with the dc waveform to generate a dimmed lamp output. An ac waveform may be utilized to drive the lamp during the full power mode of operation.

22 Claims, 5 Drawing Sheets

LLD for 350W CMH Lamps Operated Continuously at 175W DC.

LLD for 400W CMH Lamps Operated at Full and Reduced Power.

HID DIMMING METHOD AND APPARATUS

BACKGROUND

The present exemplary embodiment relates to High Intensity Discharge (HID) lamp lighting systems. It finds particular application in conjunction with metal halide lamp dimming systems and will be described with particular reference thereto. However, it is to be appreciated that the present exemplary embodiment is also amenable to other like applications, including mercury lamps and high pressure sodium (HPS) lamps.

In general, HID lamps suffer from a degradation in light output over time. This degradation in light is commonly referred to as the Lamp Lumen Depreciation (LLD) of a lamp. The LLD of a lamp is defined as the light output vs. time. When MH lamps are operated in the fully dimmed mode, the metal halide vapor pressures drop by a very large amount and the lamp reverts to a mercury discharge. A mercury discharge under these conditions will have a very poor Color Rendition Index (CRI), a low efficiency and poor LLD characteristics.

There is widespread evidence that the LLD during full power operation can be dramatically improved through the use of frequencies higher than 60 Hz. The two frequency domains that are commonly used for this are approximately 100 Hz square waves and higher frequencies of 100 to 200 KHz for 400 W lamps.

BRIEF DESCRIPTION

In accordance with one aspect of the present exemplary embodiment, a ballast lamp circuit is provided. The ballast lamp circuit comprising a HID lamp full power mode, the ballast lamp circuit configured to generate an ac waveform during the HID lamp full power mode; and a HID lamp reduced power dimming mode, the ballast lamp circuit configured to generate a dc waveform during the HID lamp reduced power dimming mode. The HID lamp reduced power dimming mode providing less power than the ac waveform during the said HID lamp full power mode and the HID reduced power dimming mode configured to provide power to a HID lamp after an initial warm up period wherein the ballast lamp circuit is configured to provide full power to the HID lamp during the HID full power mode.

In accordance with another aspect of the present exemplary embodiment, a method of operating a HID lamp is provided. The method comprising generating a dc waveform during a reduced power dimming mode, the power of the dc waveform being less than the full power rating of a lamp to be driven, and driving the lamp with the dc waveform to generate a dimmed lamp output, wherein the lamp lumen depreciation of the lamp over the life of the lamp is less with the use of the dc waveform compared to the use of an ac waveform of equal power driving the lamp to generate a dimmed lamp output.

In accordance with another aspect of the present exemplary embodiment, a ballast lamp circuit is provided. The ballast lamp circuit comprising a means for generating a dc waveform during a lamp reduced power dimming mode, the power of the dc waveform being less than the full power rating of a metal halide lamp; and a means for driving the lamp with the dc waveform to generate a dimmed lamp output.

DETAILED DESCRIPTION

Figure 1:
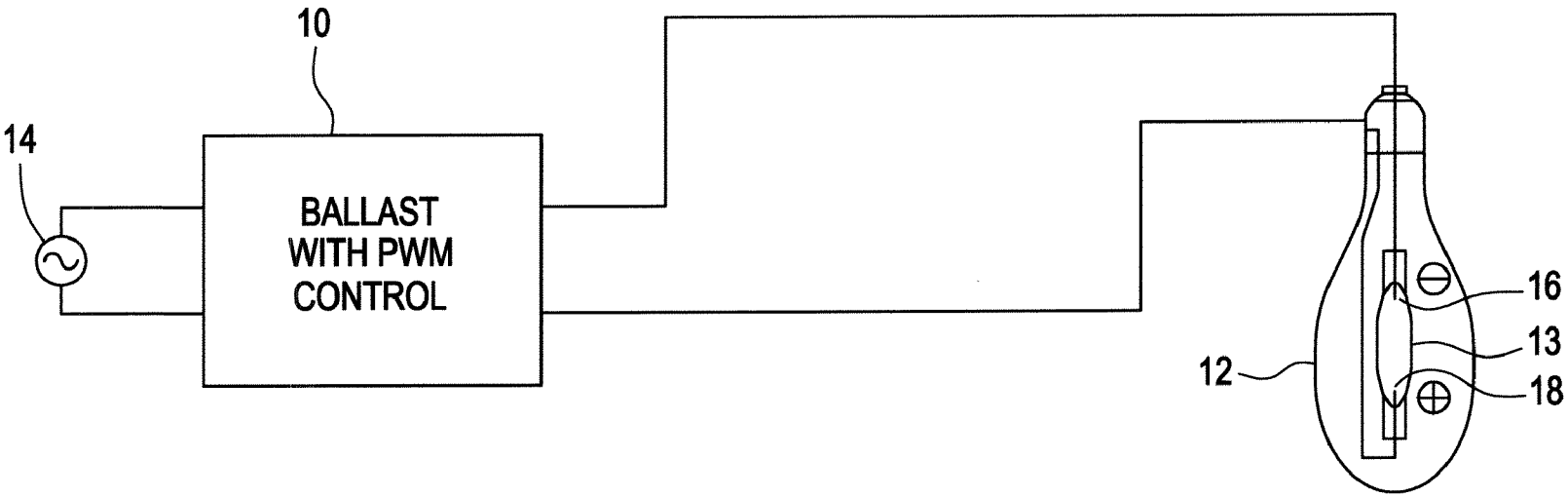
FIG. 1 is a schematic representation of a metal halide lamp and ballast circuit configuration according to one exemplary embodiment.

As briefly discussed in the background section above, HID lamps and MH lamps in particular suffer from a reduced LLD when operated at a reduced power level or what this disclosure refers to as an ac dimmed mode. The LLD of MH lamps in the dimmed mode is especially inferior when the lamp is operated at 50% or less power levels.

A primary reason for the inferior LLD of a MH lamp operated in ac dimmed mode is the lamp current is significantly less in the dimmed mode which reduces the operating temperature of the electrodes as compared to the temperature of the electrodes while operating in the full power mode. Less lamp current during the dimmed mode leads to difficulty maintaining the electrodes at a high enough temperature for good thermionic emission while the electrodes operate as cathodes. This, in turn, results in a higher rate of tungsten evaporation from the electrodes which causes blackening of the arc tube and decreases the LLD characteristics of the MH lamp.

As stated above, the problem discovered in the ac dimmed mode is the electrodes are too cool to properly support thermionic emission from the cathode electrode during the cathode cycle. This is caused by the reduced lamp current associated with lower power operation and the electrode alternating between being an anode and cathode during ac operation. In addition, the lower electrode of a vertically operated MH lamp tends to operate cooler than the upper electrode due to the fact that hot gases generated by the discharges rise. This rise of hot gases tends to heat the upper electrode while the lower electrode is actually cooled by the cooler gases that come down the arc tube inner surface and then impinges upon the lower electrode, thereby contributing to a poorer thermionic emission and LLD properties of the MH lamp.

DC operation MH lamp allows one electrode to better maintain a hot spot since the electrode will be in a continuous cathode mode. In this mode, most of the energy is dissipated in a very small area, or hot spot of the cathode surface. The electrode operating in a continuous anode mode provides a more uniform dissipation of energy over the entire anode electrode.

By operating the MH lamp using dc in the dimmed mode, there is approximately twice the energy available to maintain a cathode hot spot as compared with using 100% ac in the dimmed mode. In addition, by utilizing the upper electrode as the cathode, a relatively hotter cathode electrode is achieved which enables a stable hot spot to be maintained with relatively less power.

Alternative methods of maintaining a stable hot spot include a multiple cathode and/or multiple anode approach. During the MH dimmed mode of operation, a relatively smaller cathode is utilized, thereby improving the stability of the cathode hot spot as compared to a relatively larger cathode electrode utilized during full power operation of the MH lamp. A multiple electrode configuration also provides an improvement of LLD for ac dimming, whereby a relatively smaller pair of electrodes are utilized during the dimmed ac mode, as compared to a relatively larger pair of electrodes being utilized during the full power mode.

With reference to FIG. 1, illustrated is a schematic representation of a metal halide lamp and a ballast configuration according to one embodiment of this disclosure. This embodiment of the present disclosure provides an improved LLD during the reduced power dimming mode of a metal halide lamp.

The ballast 10 is configured to generate an ac waveform during the MH lamp full power mode and a reduced power dc waveform during the MH dimming mode. The reduced power dc waveform drives the MH lamp 12 during the dimming mode while providing an improved LLD as compared to a reduced power ac waveform driving the MH lamp.

The embodiment of the ballast circuit and MH lamp 12 configuration according to FIG. 1 includes a low frequency ballast 10. For full power ac mode operation, the low frequency ballast 10 includes three sections. The first section receives the line voltage 14, converts the line voltage 14 to dc and controls line current to maintain the line power factor above a desired design level. The second section controls the current to the MH lamp 12 and maintains the lamp 12 at a desired power level. The third section reverses the lamp voltage periodically to stabilize the chemistry of the lamp 12 and prevent separation of halides which result in color distortion. Typically, the reversing frequency is in the range of 70 to 400 Hz. The switching can be accomplished with an H arrangement of switching transistors which includes the MH lamp load in the horizontal rung of the H, and the transistors in the far upper and lower legs of the H. The upper legs are connected to the positive source and the bottom legs are connected to the negative source.

For reduced power or dimming mode operation of the MH lamp, a dc current component can be added to the lamp 12 by changing the duty cycle of the voltage reversing action of the ballast 10 from the standard 50% positive 50% negative to an asymmetric duty cycle. The dc current component can range from 0% to 100% of the lamp current by controlling the duty cycle of the voltage reversing section.

As illustrated in FIG. 1, the MH lamp 12 arc tube 13 is oriented to position the cathode 16 above the anode 18 for dc dimming mode operation. As previously discussed, this orientation of the arc tube 13 provides an improved LLD characterization because the cathode hot spot temperature is maximized or higher compared to other orientations of the arc tube 13. However, it should be understood that other orientations of a MH lamp arc tube 13 do provide an improved LLD while being operated in a dc dimming mode as compared to an ac dimming mode. For example, orienting the MH lamp arc tube horizontally provides an improved LLD while the lamp is operated in the dc dimming mode.

Other variations of the ballast configuration include generating an ac component and a dc component during the metal halide lamp reduced power dimming mode. This can be accomplished using various pulse width modulation techniques. In addition, a wide range of frequencies can be used to generate the full power ac waveform. This range includes 50 Hz to 400 Hz; however, other frequencies outside this range are within the scope of this disclosure.

Figure 2A:
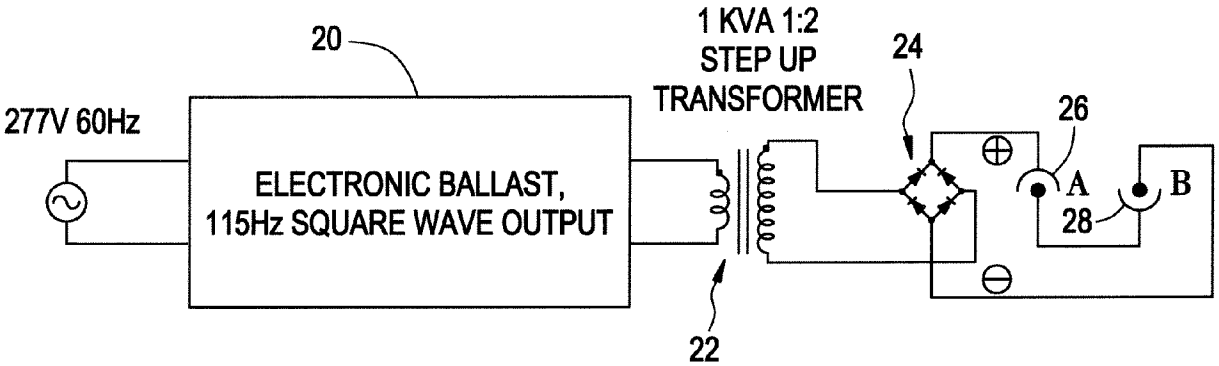
FIG. 2 is a schematic representation of metal halide lamps and ballast circuit configuration according to one exemplary embodiment.
Figure 2B:
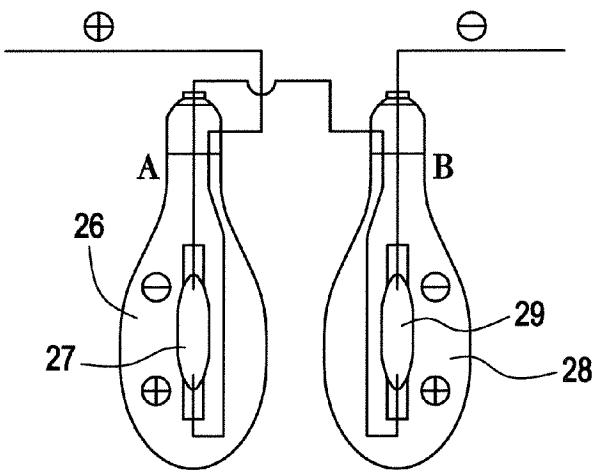

With reference to FIG. 2, illustrated is a schematic representation of a test fixture used to demonstrate the improved LLD characteristics of a MH lamp using a dc waveform for dimming. The test fixture includes an electronic ballast 20 which produces a 115 Hz square wave output. The output of the ballast 20 is connected to a 1KVA 1:2 step up transformer, the output of the transformer 22 fed to a full bridge rectifier 24 for conversion of the ac waveform to a dc waveform. The dc waveform is used to drive two MH lamps 26 and 28 in series with their cathodes oriented above the anodes.

Figure 3:
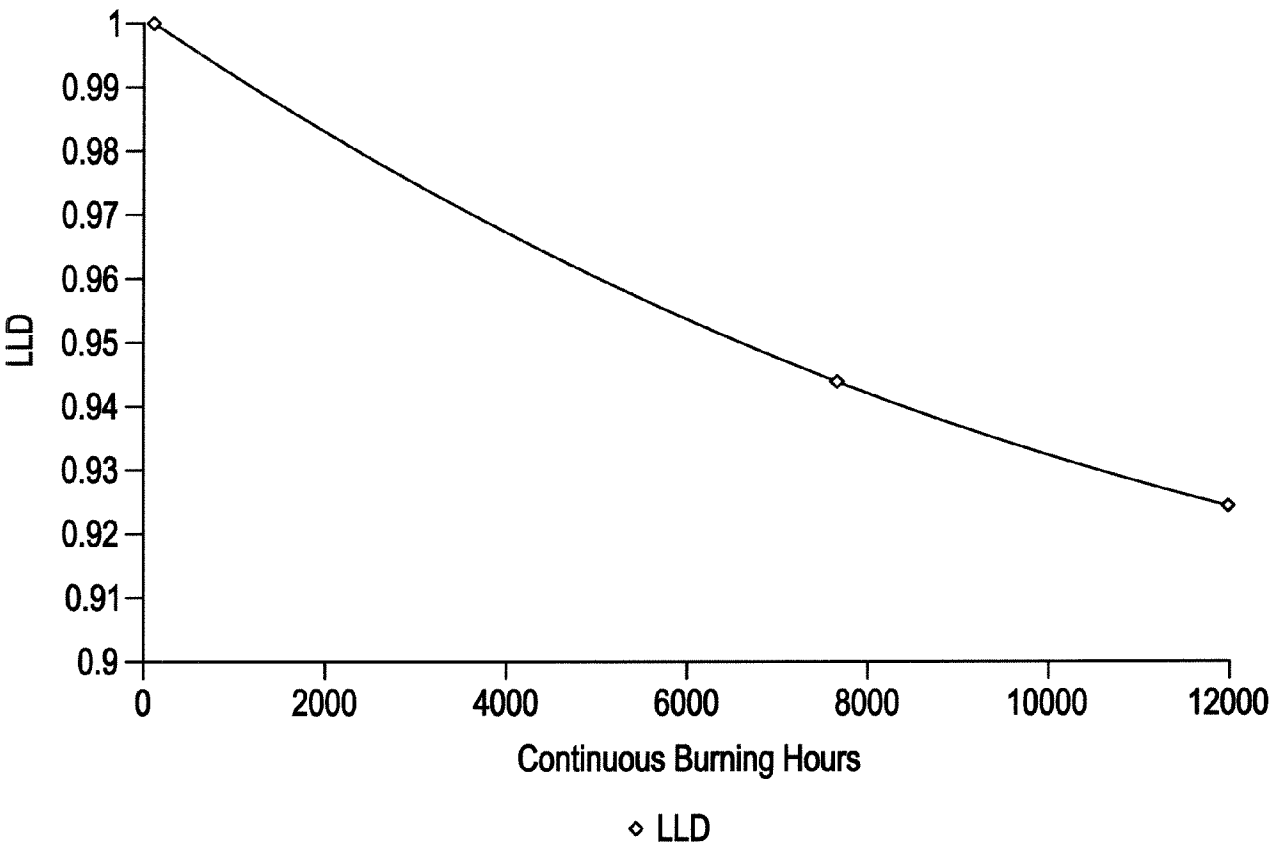
FIG. 3 is a graphical summary of the LLD for a 350 W CMH lamp operated continuously at 175 W with the cathode oriented up relative to the anode.

With reference to FIG. 3, illustrated is the LLD performance data for a 350 W CMH (Ceramic Metal Halide) lamp operated continuously at 175 W dc according to the test fixture of FIG. 2. The CMH lamp arc tubes 27 and 29 are vertically oriented to position their respective cathodes above their respective anodes. This graph demonstrates a CMH lamp can be operated continuously at 175 W dc without failures associated with electrolysis. As illustrated, the CMH Lamps operated without any failures for over 12,000 continuous burning hours.

Figure 4:
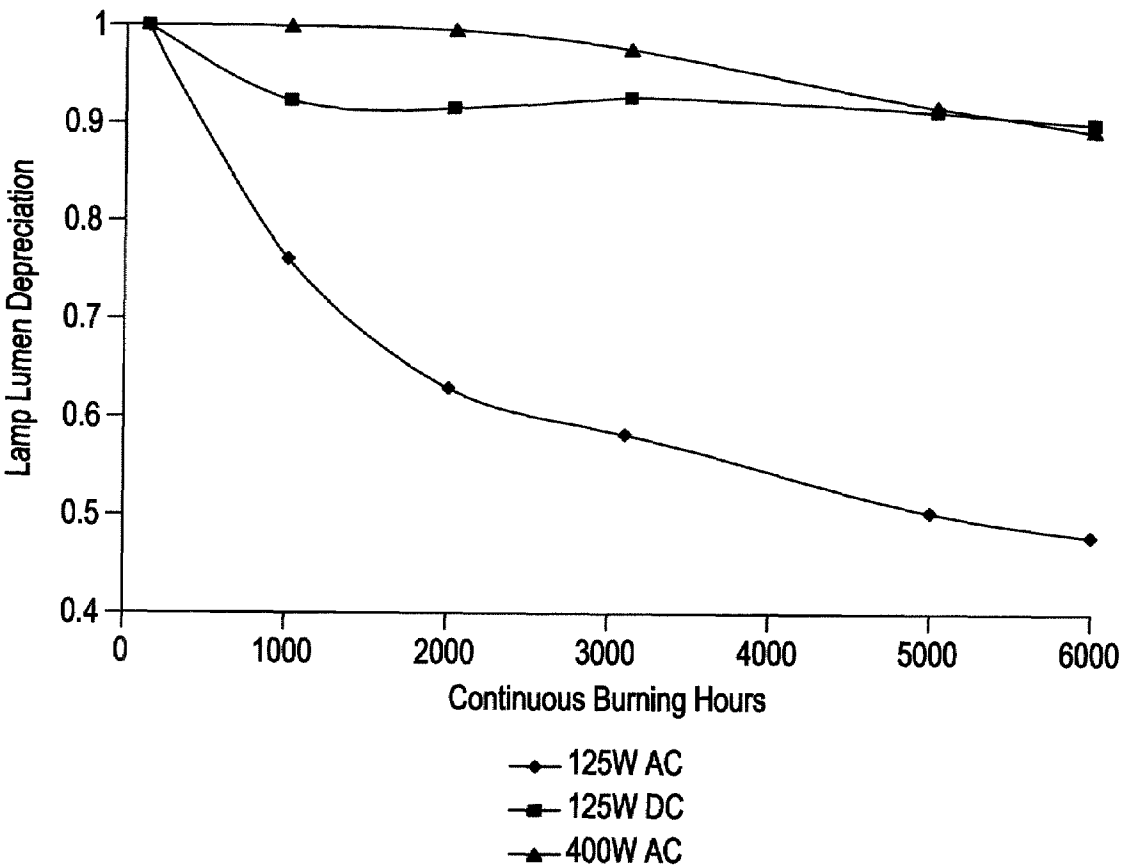
FIG. 4 is a graphical summary of the LLD for a 400 W CMH lamp according to one exemplary embodiment.

FIG. 4 illustrates the LLD characteristics of multiple MH lamps vertically oriented to position the cathode above the anode, and operated over a 6000 hour continuous burn time frame. Power was provided to the MH lamps using a low frequency (i.e. 79 Hz) square wave electronic ballast. The electronic ballast including a switch to provide full power at 400 W or dimmed power at 250 W.

With regard to the dc dimmed mode of operation, a full wave rectifier bridge was connected to the output of the electronic ballast while operating in the dimmed power mode. To provide 125 W to the MH lamps, two MH lamps were connected in series and connected to the bridge output.

With regard to the ac dimmed mode of operation, the ac output of the electronic ballast, while operating at dimmed power, was connected to two MH lamps in series, thereby providing 125 W at each MH lamp.

In summary, FIG. 4 represents LLD data taken for 400 W CMH lamps at full 400 W ac power, 125 W dc power and 125 W ac power, the 125 W data representative of a dimmed mode of operation.

As FIG. 4 shows, an improvement of the LLD during the dimmed mode is achieved utilizing a dc waveform at 125 W as compared to an ac waveform at 125 W. For example, at 6000 continuous burn hours, the LLD of a MH lamp dimmed at 125 W dc is approximately 0.9 as compared to the LLD of a MH lamp dimmed at 125 W ac approximately equal to 0.5. In addition, this data represents the CMH lamps operated with their cathodes oriented above their respective anodes contributes to an improved LLD during the dimmed mode. Other alternative arrangements of the cathode and anode include a horizontal relationship, i.e., the arc tube positioned horizontally.

Figure 5:
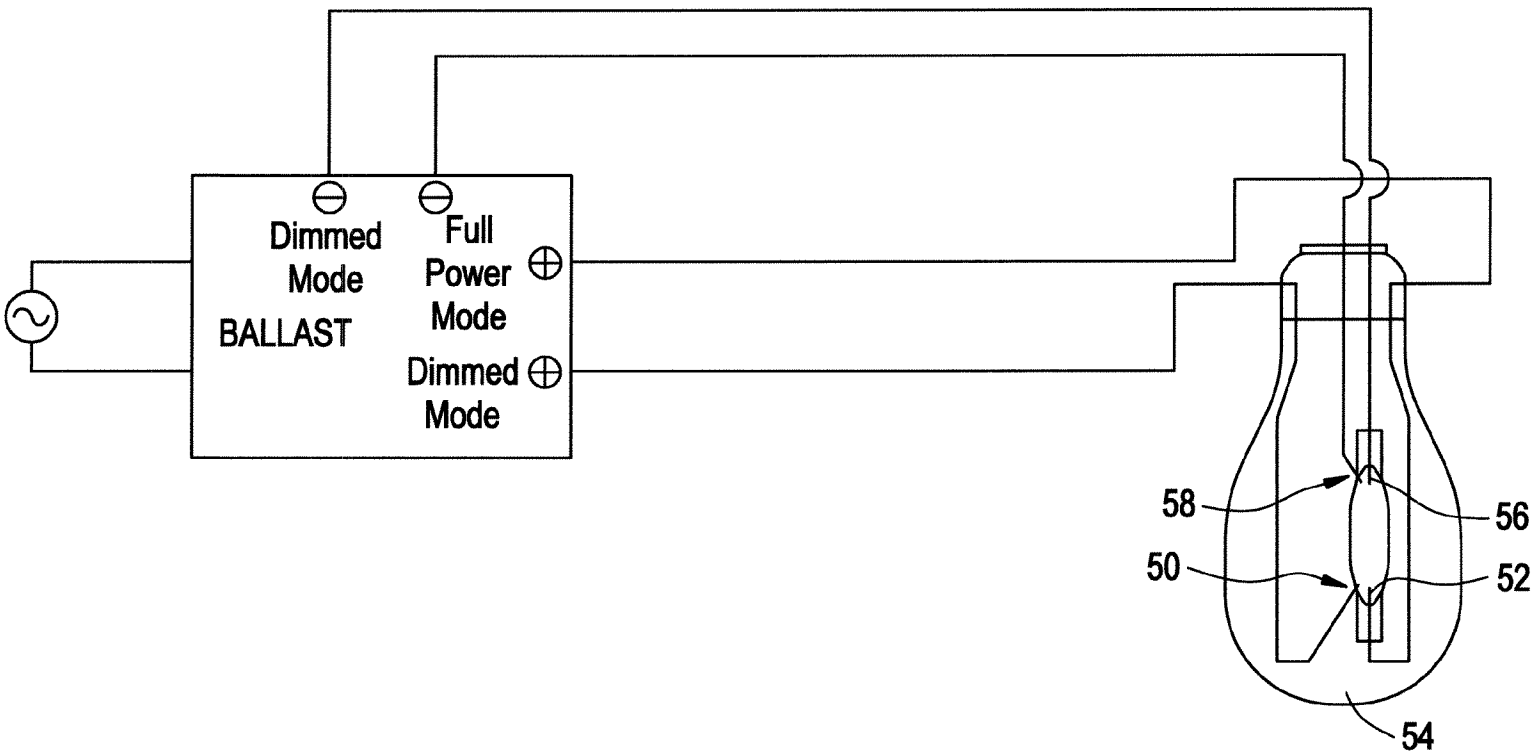
FIG. 5 is a schematic representation of a metal halide lamp and ballast circuit configuration according to one exemplary embodiment.

FIG. 5 illustrates another embodiment of the present disclosure including dedicated electrodes 50 and 52 for dimming and full power operation of a CMH lamp. Specifically, this embodiment includes a MH lamp 54 containing a first electrode pair 52 and 56 for full power ac operation and a second electrode pair 50 and 58 for ac or dc dimming mode operation. The dimming node electrodes 50 and 58 are relatively smaller than the ac full power electrodes 52 and 56. A variation of this configuration includes a common anode and independent cathodes for full power ac mode and dc dimming mode, respectively.

The discussion heretofore has been limited to an exemplary embodiment including a MH lamp dimming apparatus and method of operation. However, other HID lamps such as mercury lamps and High Pressure Sodium lamps are within the scope of this disclosure. Particularly, mercury lamps which can benefit from an improved LLD while being operated in a dimmed mode as described heretofore with reference to MH lamps. In addition, particular reference has been made to CMH lamps, however, other variations of MH lamps, including quartz MH lamps, are within the scope of the disclosure.

Furthermore, the discussion heretofore has been limited to an exemplary embodiment including an electronic ballast configuration. However, magnetic and hybrid electronic/magnetic ballasts can be utilized to provide the necessary ac waveforms and dc waveforms to drive a MH lamp according to the exemplary embodiments described.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A ballast lamp circuit comprising:

a HID lamp full power mode, the ballast lamp circuit configured to generate an ac waveform during the HID lamp full power mode; and a HID lamp reduced power dimming mode, the ballast lamp circuit configured to generate a dc waveform during the HID lamp reduced power dimming mode, the HID lamp reduced power dimming mode providing less power than the ac waveform during the said HID lamp full power mode, the HID reduced power dimming mode configured to provide power to a HID lamp after an initial warm up period wherein the ballast lamp circuit is configured to provide full power to the HID lamp during the HID full power mode, and the ballast lamp circuit is configured to generate a waveform including an ac component and a dc component during the HID lamp reduced power dimming mode.

2. The ballast lamp circuit according to claim 1, wherein the said waveform including the ac component and the dc component during the HID lamp reduced power dimming mode is generated by pulse width modulation.

3. The ballast lamp circuit according to claim 1, wherein the ac waveform operates at a frequency equal to or greater than approximately 50 Hz and less than or equal to approximately 200 k Hz.

4. The ballast lamp circuit according to claim 1, wherein the ballast lamp circuit is configured as an electronic ballast.

5. The ballast lamp circuit according to claim 1, wherein the ballast lamp circuit is configured as a magnetic ballast.

6. The ballast lamp circuit according to claim 1, wherein the ballast lamp circuit is configured as a hybrid electronic and magnetic ballast.

7. The ballast lamp circuit according to claim 1, wherein the warm up period is equal to or greater than approximately 15 minutes.

8. The ballast lamp circuit according to claim 1, the ballast lamp circuit configured to provide bi-level power operation to a HID lamp.

9. The ballast lamp circuit according to claim 1, the ballast lamp circuit configured to provide a continuous HID lamp reduced power dimming mode, wherein the continuous HID lamp reduced power dimming mode is configured to provide two or more reduced power levels to a HID lamp while the HID lamp is dimmed.

10. The ballast lamp circuit according to claim 1, wherein the ballast lamp circuit is configured to provide a minimum transition period equal to or greater than approximately 1.5 minutes during a transition from the HID lamp full power mode to the HID lamp reduced power dimming mode minimum power level.

11. The ballast lamp circuit according to claim 1, further comprising:

an ac line voltage to dc voltage converter;

an inverter configured to convert a dc output of the said converter, to the said ac waveform; and the ballast lamp circuit configured to generate the said dc waveform from the said dc outputs.

12. The ballast lamp circuit according to claim 1, further comprising:

a HID lamp operatively connected to the ballast lamp circuit, the HID lamp being driven by the ac waveform while the HID lamp is operating in the full power mode and the HID lamp being driven by the dc component and the ac component of the waveform while the HID lamp is operating in the dimming mode.

13. The ballast lamp circuit according to claim 12, the HID lamp comprising a mercury lamp.

14. The ballast lamp circuit according to claim 12, the HID lamp comprising a high pressure sodium lamp.

15. The ballast lamp circuit according to claim 12, wherein the HID lamp reduced power dimming mode provides 50% or more of the maximum rated power of the HID lamp and less than 100% of the maximum rated power of the HID lamp.

16. The ballast lamp circuit according to claim 12, wherein the HID lamp reduced power dimming mode provides 25% or more of the maximum rated power of the HID lamp and less than 100% of the maximum rated power of the HID lamp.

17. The ballast lamp circuit according to claim 12, wherein the HID lamp is rated at less than or equal to approximately 2000 watts and greater than or equal to approximately 35 watts.

18. The ballast lamp circuit according to claim 12, wherein the HID lamp is rated at 400 watts maximum power, and the ballast lamp circuit ac waveform provides approximately 400 watts to the lamp, and the ballast lamp circuit dc waveform provides approximately 200 watts or less to the HID lamp.

19. The ballast lamp circuit according to claim 12, wherein the HID lamp is rated at 400 watts maximum power and the ballast lamp circuit ac waveform provides approximately 400 watts to the lamp and the ballast lamp circuit dc waveform provides approximately 125 watts or less to the lamp.

20. A ballast lamp circuit comprising:

a HID lamp full power mode, the ballast lamp circuit configured to generate an ac waveform during the HID lamp full power mode;

a HID lamp reduced power dimming mode, the ballast lamp circuit configured to generate a dc waveform during the HID lamp reduced power dimming mode, the HID lamp reduced power dimming mode providing less power than the ac waveform during the said HID lamp full power mode, the HID reduced power dimming mode configured to provide power to a HID lamp after an initial warm up period wherein the ballast lamp circuit is configured to provide full power to the HID lamp during the HID full power mode; and a HID lamp having an arc tube, a first electrode and a second electrode operatively connected to the ballast lamp circuit, wherein the first electrode is positioned above the second electrode, and the first electrode functions as a cathode during the HID lamp reduced power dimming mode and the second electrode functions as an anode during the HID lamp reduced power dimming mode.

21. The ballast lamp circuit according to claim 12, the HID lamp comprising a metal halide lamp.

22. The ballast lamp circuit according to claim 21, the metal halide lamp comprising:

an arc tube containing an ionizable medium, the ionizable medium including mercury, at least one metal halide and an inert gas; and a first electrode and a second electrode sealed into opposite ends of the arc tube.

* * * * *